United States Patent [19]

Barnes

[11] 4,390,173

[45] Jun. 28, 1983

[54] ADJUSTABLE ANKLE STIRRUP DEVICE FOR A CHIROPRACTIC TABLE

[75] Inventor: James E. Barnes, Fort Wayne, Ind.

[73] Assignee: James M. Cox, Spencerville, Ind. ; a part interest

[21] Appl. No.: 287,413

[22] Filed: Jul. 27, 1981

[51] Int. Cl.[3] ..... A61G 13/00

[52] U.S. Cl. ..... 269/328

[58] Field of Search ..... 269/322–328, 269/45, 63; 5/443; 128/133, 134; 108/28; 248/499, 505, 293, 298, 285, 296

[56] References Cited

U.S. PATENT DOCUMENTS 3,329,423 7/1967 Kleinman ..... 269/328

3,516,652 6/1970 Roblee ..... 269/328

3,528,413 9/1970 Aydt ..... 269/328

*Primary Examiner*—Robert C. Watson

*Attorney, Agent, or Firm*—Gust, Irish, Jeffers & Hoffman

[57] ABSTRACT

This invention relates to an adjustable ankle stirrup device for a chiropractic table adapted to mount straps which may be affixed to the ankles for restraining patient movement toward the head of the table during treatment. The stirrup device includes two stirrup brackets mounted on opposite sides of the table which are adjustable longitudinally thereof and vertically supportable in selected positions to accommodate patients of different heights.

6 Claims, 6 Drawing Figures

ADJUSTABLE ANKLE STIRRUP DEVICE FOR A CHIROPRACTIC TABLE

BACKGROUND OF THE INVENTION

1. Field of the Invention

The present invention relates to accessories for chiropractic tables and particularly to an adjustable ankle stirrup device.

2. Description of the Prior Art

Conventionally, chiropractic tables are provided with ankle stirrups which include upstanding brackets on opposite sides of the table fixedly mounted near the foot thereof. Leather straps or the like are secured to the brackets and are adpated to be wrapped around the patient's legs near the ankles for restraining the patient against movement toward the head of the table during treatment. For a short person, since the stirrups are located near the foot of the table, applying the ankle straps positions the patient improperly too far toward the foot of the table. In those instances the straps are not used, requiring other techniques for retaining the patient in proper position on the table.

SUMMARY OF THE INVENTION

This invention relates to an adjustable ankle stirrup device for a chiropractic table comprising a table having top and bottom surfaces, side edges and a foot portion. Two bars are fixedly supported on said table to extend longitudinally thereof in spaced parallelism with the bottom surface, the two bars being located adjacent to the side edges of the table, respectively. Two stirrup brackets, each having two angularly related legs with the end portion of one leg thereof slidably mounted on the respective bar, may be positioned such that the other legs thereof extend upright along the respective table edges. Retaining-hook elements are mounted on the table to extend below the bottom surface, the open portions of such hook elements extending toward the foot of the table in registry with the one leg of the respective brackets. The brackets are slidable on the respective bars to different longitudinal table positions in which they may be selectively engaged with the respective hook elements for positively locating the other leg portions of the brackets in upright positions adjacent to the respective side edges of the table. Straps mounted on the upright bracket legs are adapted to be secured to the ankles of a patient.

It is an object of this invention to provide an adjustable ankle stirrup device for a chiropractic table.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
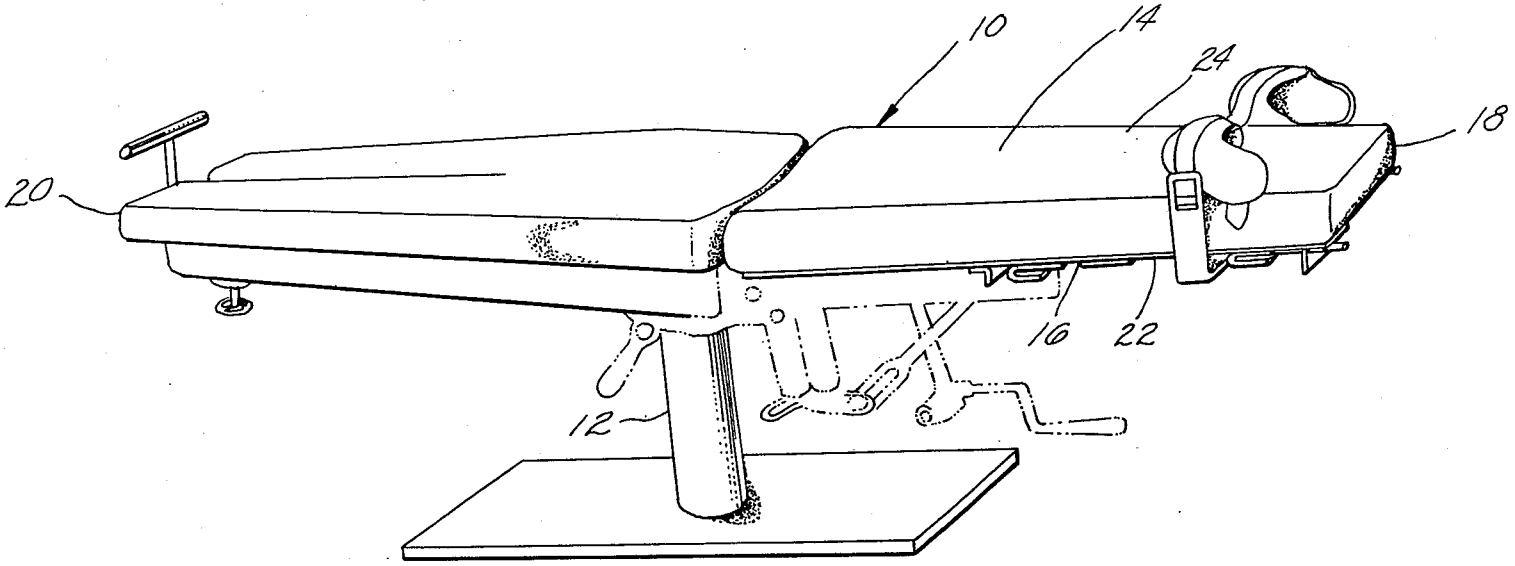
FIG. 1 is a perspective view of a typical chiropractic table employing one embodiment of this invention.
Figure 2:
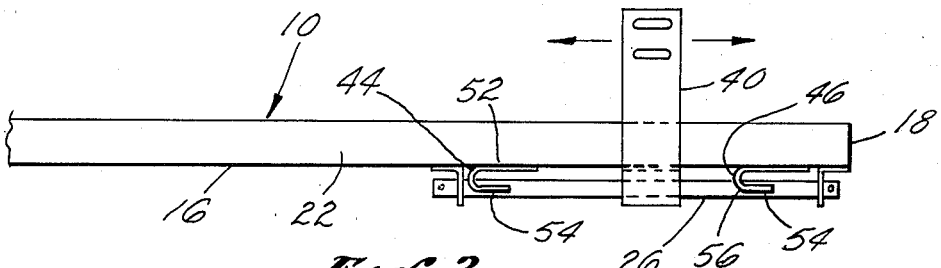
FIG. 2 is a fragmentary side view of such table showing a stirrup device of this invention mounted thereon.

Referring to the drawings, a typical chiropractic table 10 is mounted on a supporting pedestal 12, the table having top and bottom surfaces 14 and 16, respectively, a foot portion 18, a head portion 20 and opposite side edges 22 and 24. On the bottom surface 16 is mounted two round bars 26 and 28 by means of right angle brackets 30 and 32 which are secured to the bottom surface 16 adjacent to the table sides 22 and 24. The brackets 30 and 32 have depending legs provided with holes which receive the ends of the respective bars 26 and 28, suitable pins or keys being received in the ends for retaining the bars in assembly with the brackets. The bars 26 and 28 extend longitudinally of the table 10 in substantial parallelism with the respective side edges 22 and 24 and the bottom surface 16.

Slidably mounted on the bars 26 and 28 are two right angle stirrup brackets 34 and 36, respectively, having legs 38 and 40. On the distal end of leg 38 is a sleeve bearing 42 which rotatably and slidably receives the respective bar 26, 28.

Disposed adjacent to the side edges 22 and 24 of the table and between such side edges and the respective bars 26 and 28 are four retaining-hook elements 44, 46, 48 and 50 which are U-shaped. These hook elements are identically shaped, so a description of one will suffice for all. One arm 52 of the hook element is flat and longer than the other arm 54. The longer arm 52 is secured flat against the bottom surface 16 so that the hook element extends generally parallel to the respective bar 26, 28. The shorter arm 54 also extends parallel to the respective bar and furthermore parallel to the bottom surface 16. Since the bottom surface 16 is substantially horizontal, so will be the arm 54.

The bight 56 of each hook element is disposed toward the head end of the table thereby disposing the open portion of the hook element toward the foot. The hooks 44 and 46 are longitudinally spaced as shown as are the hook elements 48 and 50. The hooks 44 and 48, as are the hooks 46 and 50, are disposed transversely opposite of the table as are the other elements common to the two stirrup assemblies. The leg portions 40 of the stirrup brackets have slots 58 therein for receiving ankle straps 60.

Figure 3:
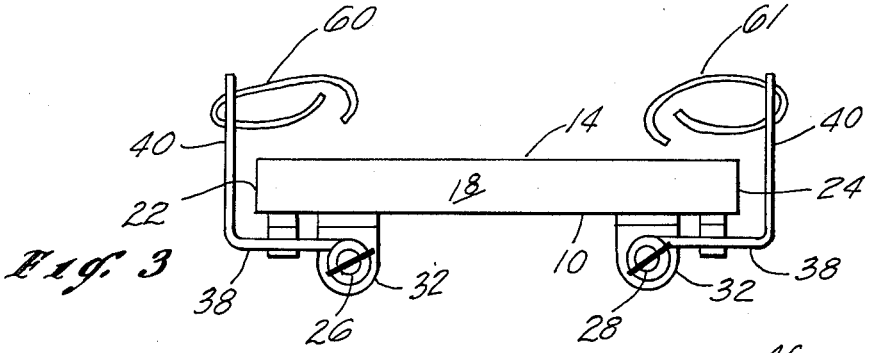
FIG. 3 is a view taken from the foot end of the table.
Figure 4:
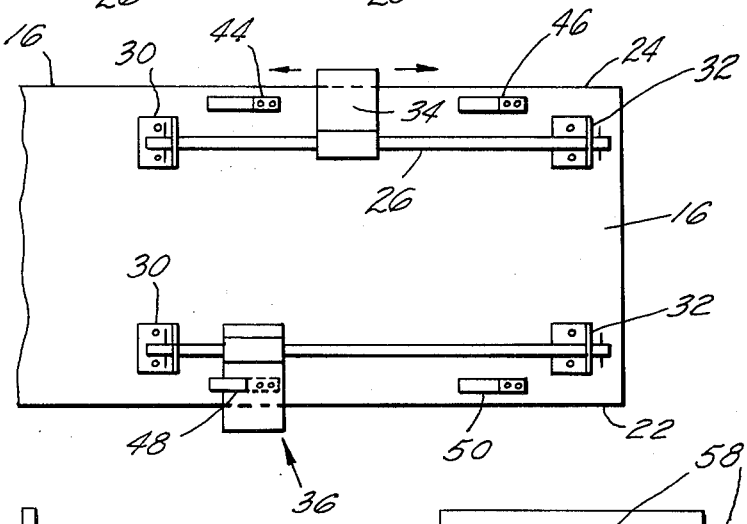
FIG. 4 is a bottom plan view thereof.
Figure 5:
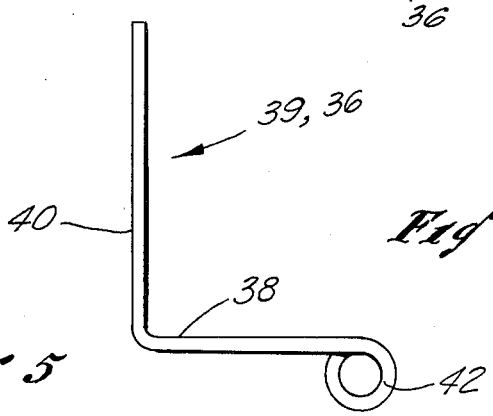
FIG. 5 is an edge view of one of the stirrup brackets.
Figure 6:
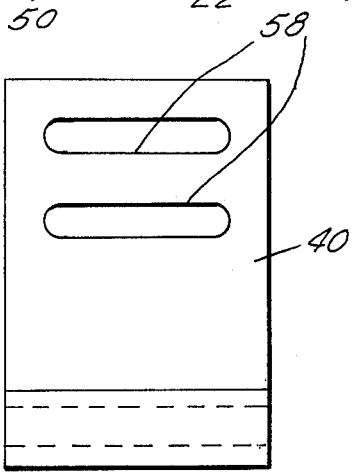
FIG. 6 is a front view thereof.

In use, the stirrup brackets 34, 36 are slidable longitudinally on the respective bars 26, 28 and also swingable thereabout. The bracket 34, for example, is slidable on the bar 26 to a position at which the leg 38 can be brought into registry with the open portion of the hook 46 moved thereinto up against the bight 56. The leg 38 thus rests on the hook portion 54 thereby positioning the bracket leg 40 upright as shown in FIG. 3. The other stirrup bracket 36 may likewise be engaged with the hook 50. The straps 60 may be wrapped about a patient's ankles. If in the treatment the patient is pushed or stretched toward the head end 20 of the table, the ankle straps 60 will restrain such movement. For a shorter patient, the stirrup brackets 34 and 36 are engaged with the two hook elements 44 and 48 and the procedure just described is repeated. Additional pairs of hook elements may be employed to obtain further increments of longitudinal adjustment of the stirrup brackets, but in a preferred embodiment of this invention, only two such adjustments are deemed necessary.

While there have been described above the principles of this invention in connection with specific apparatus, it is to be clearly understood that this description is made only by way of example and not as a limitation to the scope of the invention.

What is claimed is:

1. Chiropractic table apparatus comprising a table having top and bottom surfaces, side edges and a foot portion, a bar fixedly supported on said table to extend longitudinally thereof in spaced parallelism with said bottom surface, a stirrup bracket having two angularly related legs with the end portion of one leg being slidably mounted on said bar and the other leg being adapted to extend upright along one end of said table, and means for disengageably supporting said bracket at a selected position longitudinally of the table with said other leg upright and for restraining movement of said bracket in a direction away from said foot portion while in said position, said means including a hook element on said table and extending beneath said bottom surface to be disposed in registry with said one leg of said bracket, said hook element having an open portion extending substantially parallel to said bar and adapted to disengageably receive said one leg in supporting relation.

2. The apparatus of claim 1 wherein said hook element is U-shaped with one arm secured to said bottom surface and the other arm extending parallel thereto and to said bar, said hook element being disposed between said bar and said one edge of said table whereby engagement of said one leg with said hook element positions said other leg upright along said one table edge.

3. The apparatus of claim 2 including a second hook element like the first and positioned in registry with said one leg with the open portion thereof extending in the same direction, said open portions being toward the foot of said table, said hook elements being spaced apart longitudinally of said table in parallelism with said bar whereby said bracket may be moved along said bar for supporting engagement with a selected one of said hook elements.

4. The apparatus of claim 3 wherein said one arm of each of said hook element is mounted flat against said bottom surface such that the other arm is spaced therefrom in parallelism therewith.

5. The apparatus of claim 4 wherein said one leg has a bearing on the distal end which slidably receives said rod, and two mounting brackets secured to said bottom surface in spaced relation and having the opposite ends of said bar secured thereto.

6. The apparatus of claim 5 including a second assembly of a bar, hook elements, and stirrup bracket like that first mentioned, said assemblies being disposed adjacent to the opposite edges, respectively, of said table with the common elements of said assemblies being transversely opposite each other.

* * * * *